US007341335B2

(12) United States Patent
Akahane et al.

(10) Patent No.: US 7,341,335 B2
(45) Date of Patent: Mar. 11, 2008

(54) LIQUID EJECTION APPARATUS

(75) Inventors: Fujio Akahane, Nagano-ken (JP); Hisashi Miyazawa, Nagano-ken (JP); Shuichi Tanaka, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 348 days.

(21) Appl. No.: 11/233,117

(22) Filed: Sep. 23, 2005

(65) Prior Publication Data

US 2006/0066695 A1 Mar. 30, 2006

(30) Foreign Application Priority Data

Sep. 24, 2004 (JP) ..... 2004-276603
Aug. 8, 2005 (JP) ..... 2005-229746

(51) Int. Cl.
*B41J 2/175* (2006.01)

(52) U.S. Cl. ..... 347/85

(58) Field of Classification Search ..... 347/7, 347/84, 85; 141/2, 18
See application file for complete search history.

(56) References Cited

U.S. PATENT DOCUMENTS 4,074,284 A * 2/1978 Dexter et al. ..... 347/49
5,732,751 A * 3/1998 Schmidt et al. ..... 141/48
6,193,364 B1 * 2/2001 Iida ..... 347/86
6,520,630 B1 * 2/2003 Oda et al. ..... 347/85
6,796,627 B2 * 9/2004 Kimura et al. ..... 347/7
6,929,357 B2 * 8/2005 Qingguo et al. ..... 347/85

FOREIGN PATENT DOCUMENTS

JP 5-185603 A 7/1993

* cited by examiner

*Primary Examiner*—Anh T. N. Vo
(74) *Attorney, Agent, or Firm*—Sughrue Mion, PLLC

(57) ABSTRACT

A liquid ejection apparatus ejects liquid retained in a liquid container from a liquid ejection head. The apparatus includes a liquid supply needle having an outlet line that can be connected to the interior of the liquid container, a liquid supply line connecting the outlet line of the liquid supply needle to the recording head, and a control valve provided in the liquid supply line. The control valve closes the liquid supply line when negative pressure is applied to the liquid ejection head. A seal valve is arranged between the control valve and the liquid supply needle in the liquid supply line. The seal valve seals the liquid supply line using liquid pressure applied from the control valve to the outlet line. Accordingly, the liquid is prevented from leaking from the liquid supply needle when the liquid container is separated from the liquid supply needle.

12 Claims, 6 Drawing Sheets

LIQUID EJECTION APPARATUS

CROSS-REFERENCE TO RELATED APPLICATIONS

This application is based upon and claims the benefit of priority from prior Japanese Patent Applications No. 2004-276603, filed on Sep. 24, 2004 and No. 2005-229746, filed on Aug. 8, 2005, the entire contents of which are incorporated herein by reference.

BACKGROUND OF THE INVENTION

The present invention relates to liquid ejection apparatuses in which liquid is retained in a container, supplied to a liquid ejection head through a liquid supply needle having a liquid outlet line, and then ejected to an ejection object.

By way of example, an inkjet recording apparatus will be described as follows. The inkjet recording apparatus has a pressure chamber for pressurizing ink. The ink is then ejected from nozzles to a recording paper, or the ejection object, as ink droplets. Printing data is thus recorded on the recording paper. In the apparatus, printing problems may me caused by vaporization of solvent of the ink from nozzle openings, which may increase the viscosity of the ink, solidify the ink, and allow dust deposition in the nozzle openings, and bubbles trapped in the pressure chamber. Therefore, a capping device is deployed for preventing such vaporization by sealing the nozzle openings when printing is not performed. More specifically, a pump unit generates negative pressure in the capping device and the negative pressure is applied to the nozzle openings for forcibly discharging the ink from the nozzle openings. In other words, the pump unit performs cleaning by forcibly drawing the ink with the increased viscosity and the dust from the nozzle openings by the negative pressure generated in the capping device.

Further, for improving color printing quality, some recording apparatus may use eight types of ink, which are dark and light types of magenta, cyan, yellow, and magenta.

In these cases, ink cartridges must be provided in a quantity sufficient for the eight color inks. This may result in an excessive total weight of a carriage if the apparatus is an on-carriage type in which the ink cartridges are installed in the carriage. It is thus necessary to increase the power of the motor for driving the carriage. Further, relatively great reactive force may be generated in the carriage when the carriage is returned.

To solve these problems, the ink cartridges may be received in a cage-like body attached to the recording apparatus. The ink is supplied from each of the ink cartridge to a recording head serving as the liquid ejection head through an ink supply tube. For maintaining the apparatus as a whole in a well-proportioned state in terms of the weight, it is desired that four of the eight ink cartridges be provided at a lateral end of the apparatus with the remaining four arranged at the opposing end.

In this apparatus, which is called an off-carriage type, the ink in each of the ink cartridges is pressurized to a predetermined level for reliably sending the ink from the ink cartridge, or a liquid container, to the recording head.

Further, if the recording apparatus tilts laterally with the ink cartridges installed therein while, for example, being moved to a different position, water head pressure with respect to the recording head is raised in the group of the ink cartridges located at the affected end of the apparatus. In this case, if each ink cartridge does not have a liquid absorption member formed by a porous body, the ink may leak from the nozzle openings of the recording head.

A recording apparatus described in Japanese Laid-Open Patent Publication No. 5-185603 includes an ink cartridge having a hollow ink supply needle extending from the body of the recording apparatus. When the ink cartridge is installed in the recording apparatus, the ink supply needle is inserted in and projects from the ink cartridge. The interior of the ink supply needle defines an ink outlet line. The ink outlet line of the ink supply needle is connected to a recording head through an ink supply line defined by, for example, a tube. The ink is thus supplied to the recording head through the ink supply needle and the ink supply line.

In this apparatus, a control valve is provided in the ink supply line extending from the outlet line of the ink supply needle to the recording head, for preventing the ink from leaking from nozzle openings of the recording head. The control valve is closed when the recording apparatus is moved or the ink cartridge is installed in or removed from the apparatus. The ink is thus stopped from leaking from the nozzle openings or the ink supply needle.

However, in a state transitional from an open state to a closed state of the control valve, or when the opening degree of the control valve is decreasing, the body of the control valve moves in such a manner as to restrict the communication area of the ink supply line. This causes the ink to flow back from the control valve to the ink supply needle. In this state, if the ink cartridge is separated from the ink supply needle, the ink in the outlet line of the ink supply needle is pressed by the body of the control valve that is being closed. The ink thus drops, or leaks, from an inlet port of the ink supply needle. The ink may contaminate the portion of the recording apparatus in the vicinity of the ink supply needle. Further, the ink may flow into small gaps defined in the recording apparatus.

SUMMARY OF THE INVENTION

Accordingly, it is an objective of the present invention to provide a liquid ejection apparatus capable of preventing liquid from leaking from a liquid supply needle when a liquid container is separated from the liquid supply needle.

To achieve the foregoing and other objectives and in accordance with the purpose of the present invention, the invention provides a liquid ejection apparatus ejecting a liquid retained in a liquid container from a liquid ejection head. The apparatus includes a liquid supply needle having an outlet line that can be connected to the interior of the liquid container, a liquid supply line connecting the outlet line of the liquid supply needle to the liquid ejection head, and a control valve provided in the liquid supply line. The control valve closes the liquid supply line when negative pressure is applied to the liquid ejection head. A seal valve is arranged between the control valve and the liquid supply needle in the liquid supply line. The seal valve seals the liquid supply line using liquid pressure applied from the control valve to the outlet line.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

FIGS. 1 to 4B show a liquid ejection apparatus according to a first embodiment of the present invention.

Although the liquid ejection apparatus is capable of ejecting different types of liquid, the following description discusses about an inkjet recording apparatus by way of example.

Figure 1:
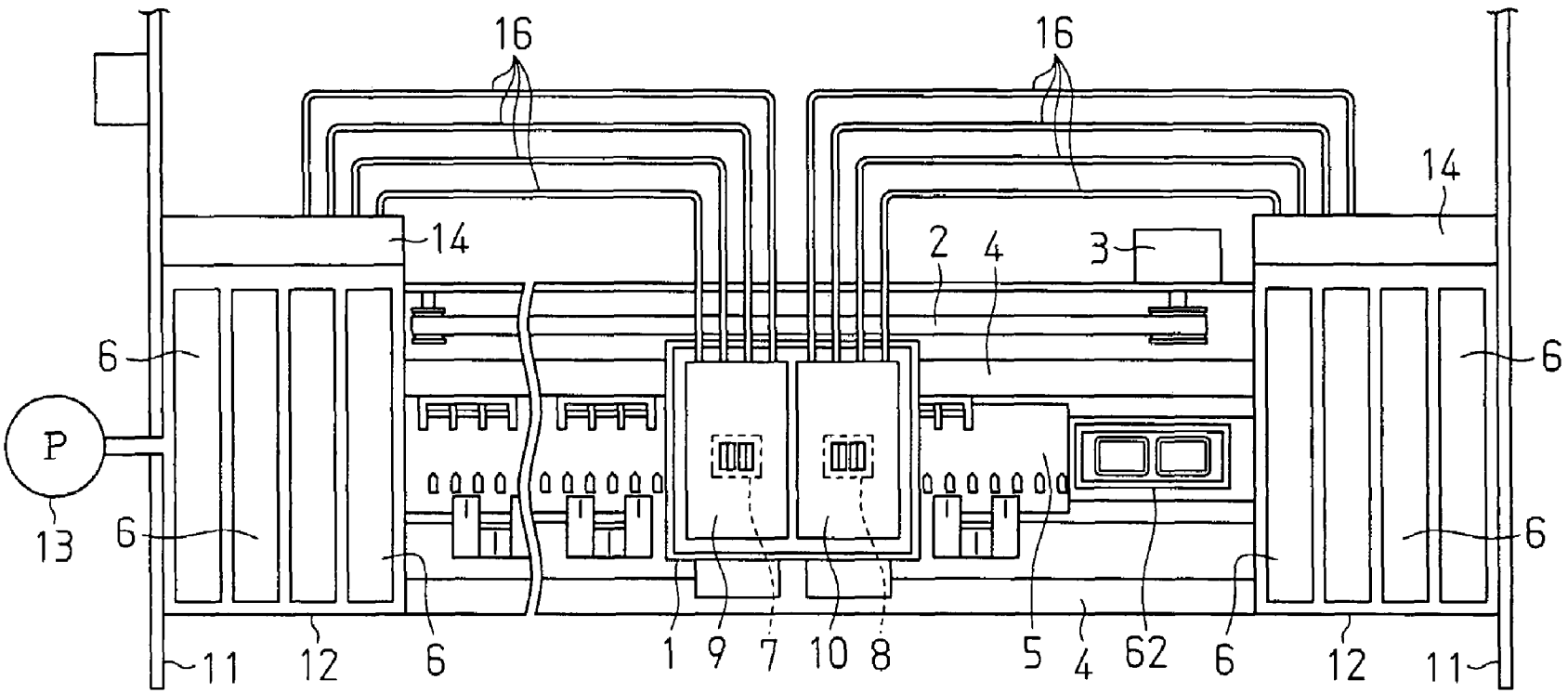
FIG. 1 is a plan view showing an inkjet recording apparatus as a whole according to a first embodiment of the present invention.

As shown in FIG. 1, a plan view showing the recording apparatus, the apparatus includes a body having a carriage 1 in which first and second recording heads 7, 8 are formed. The carriage 1 is connected to a motor 3 through a timing belt 2 and moves parallel with a platen 5 as guided by two guide members 4 extending parallel with each other. The first and second recording heads 7, 8 are provided on a surface of the carriage 1 opposed to a recording paper 19. The first and second recording heads 7, 8 are arranged side by side along a movement direction of the carriage 1. Sub tank units 9, 10 are provided on an upper surface of the carriage 1 in correspondence with ink cartridges. Each of the sub tank units 9, 10 functions as a damper against ink pressure.

The recording apparatus includes a frame 11, which is a base member (an immovable member) of the recording apparatus. Two box-like cartridge accommodation casings 12 are provided at opposing ends of the frame 11. Each of the cartridge accommodation casings 12 accommodates four ink cartridges 6. A valve unit 14 is attached to each cartridge accommodation casing 12. The four ink cartridges 6 at the left side of FIG. 1 are connected to four ink supply tubes 16 through the corresponding valve unit 14. The ink supply tubes 16 are connected to the sub tank unit 9. Likewise, the four ink cartridges 6 at the right side of the drawing are connected to four ink supply tubes 16 through the corresponding valve unit 14. The ink supply tubes 16 are connected to the sub tank unit 10. The cartridge accommodation casings 12 are secured to the frame 11 of the recording apparatus. A capping device 62 seals nozzle surfaces of the first and second recording heads 7, 8 when the apparatus performs cleaning.

Figure 2:
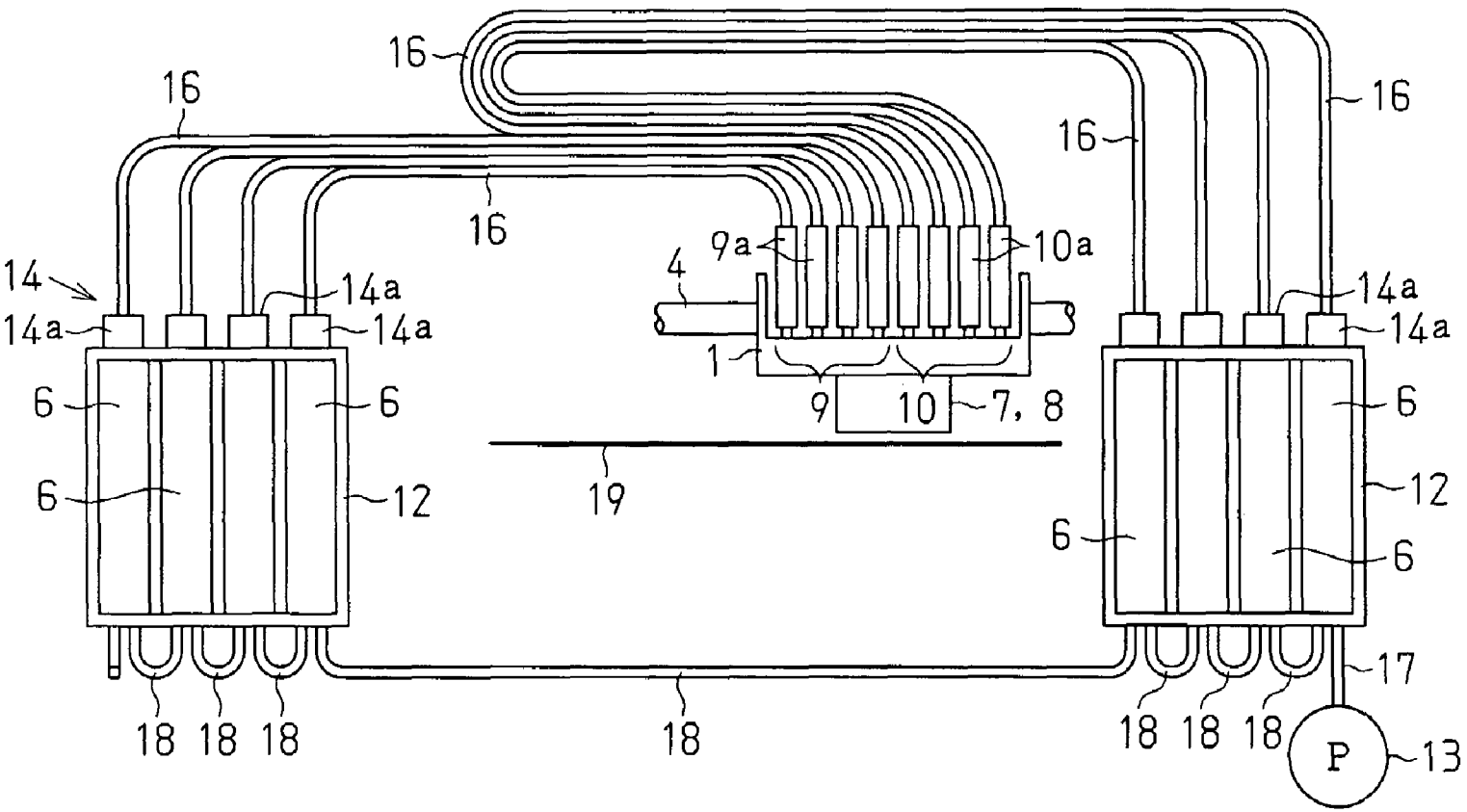
FIG. 2 is a distribution diagram representing ink passages of the apparatus of FIG. 1.

FIG. 2 is a distribution diagram showing ink passages of the recording apparatus. An air supply pipe 17 extending from a pressurization pump 13 is connected to one of the four ink cartridges 6 of each cartridge accommodation casing 12. The pressurization pump 13 supplies compressed air to the ink cartridges 6 for pressurizing the ink in the ink cartridges 6. The ink cartridges 6 of each cartridge accommodation casing 12 communicate with one another through a plurality of communication lines 18. This allows the pressurized air supplied by the pressurization pump 13 to pressurize the ink in each of the ink cartridges 6. The pressurized air thus flows through the elongated ink supply tubes 16 smoothly and is supplied to the sub tank units 9, 10. The ink is then ejected from the nozzle surfaces of the first and second recording heads 7, 8 to the recording paper 19. As illustrated in FIG. 2, each of the sub tank units 9, 10 includes sub tanks 9*a*, 10*a* that are provided separately for the ink cartridges 6.

With reference to FIG. 2, each of the valve units 14 includes four valve devices 14*a* that are provided in correspondence with the ink cartridges 6.

Figure 3A:
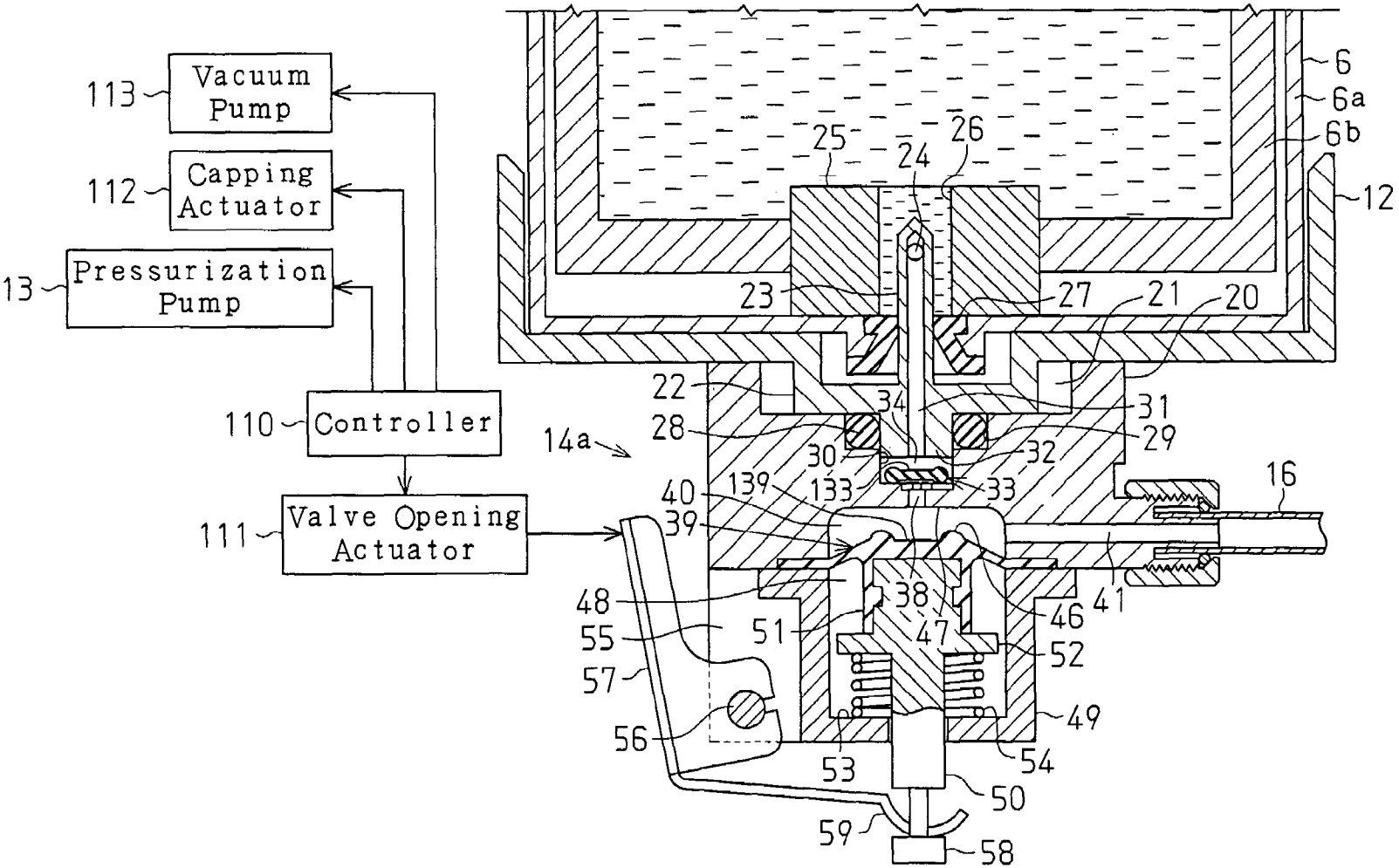
FIG. 3A is a cross-sectional view showing a valve unit of the apparatus of FIG. 1.

FIG. 3A is an enlarged cross-sectional view showing one of the valve devices 14*a*. The valve device 14*a* includes an ink supply needle 23 that can be inserted into the corresponding ink cartridge 6. The ink supply needle 23 has an ink outlet line 31, i.e., a needle passage, defined in the interior. The ink outlet line 31, which extends along the ink supply needle 23, has an inlet port 24 and an outlet port 31*a*. The inlet port 24 has an opening at a distal end of the ink supply needle 23 and the outlet port 31*a* has an opening at a basal end of the ink supply needle 23. The ink flows into the ink outlet line 31 from the inlet port 24 and is sent to an ink line defined in the valve device 14*a*. The valve device 14*a* has a seal valve 133, a control valve 139, and an operational lever 57. The ink line in the valve device 14*a* includes a seal valve chamber 34 that receives the seal valve 133, a control valve chamber 40 that receives the control valve 139, and an outlet hole 41 for sending the ink from the control valve chamber 40 to the corresponding ink supply tube 16. The seal valve chamber 34 communicates with the ink outlet line 31 and the control valve chamber 40 communicates with the seal valve chamber 34.

The valve device 14*a* includes a body 20 joined with the associated cartridge accommodation casing 12. A recess 21 is defined in the upper surface of the body 20. A projection 22 projects downward from the center of the bottom of the cartridge accommodation casing 12. The projection 22 is received in the associated recess 21. The ink supply needle 23 extends upward from the center of the projection 22. The ink outlet line 31 of the ink supply needle 23 communicates with the ink cartridge 6. In the structure of FIG. 3A, the ink supply needle 23 is formed integrally with the cartridge accommodation casing 12. However, the ink supply needle 23 may be first formed separately from the cartridge accommodation casing 12 and then assembled with the cartridge accommodation casing 12.

Each of the ink cartridges 6 has a double-wall structure including an outer casing 6*a* and an inner casing 6*b*. The inner casing 6*b* retains ink and the outer casing 6*a* receives the inner casing 6*b*. A guide cylinder 25 is attached to the center of the bottom of the inner casing 6*b*. An in-cylinder passage 26 is defined in the guide cylinder 25 for receiving the ink in the inner casing 6*b*. A seal member 27 is embedded in a portion of the outer casing 6*a* opposed to the in-cylinder passage 26. The ink supply needle 23 is passed through the seal member 27 and received in the in-cylinder passage 26. The seal member 27 is held in tight contact with the outer circumferential surface of the ink supply needle 23. This allows the seal member 27 to prevent the ink in the ink cartridge 6 from flowing along the surface of the ink supply needle 23 and leaking to the exterior of the ink cartridge 6. The seal member 27 is formed of elastic material such as elastomer. When the ink cartridge 6 is separated from the ink supply needle 23, the seal member 27 elastically restores its original shape and thus closes the in-cylinder passage 26. That is, the seal member 27 constantly prevents the ink in the ink cartridge 6 from leaking to the exterior through the in-cylinder passage 26, regardless of whether the ink supply needle 23 is received in or separated from the ink cartridge 6.

Figure 3B:
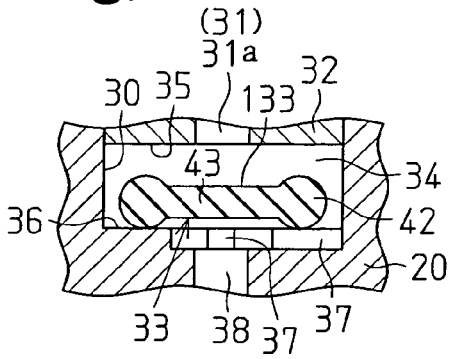
FIG. 3B is an enlarged cross-sectional view showing a seal valve of FIG. 3A, as taken along line B-B of FIG. 3C.

As shown in FIGS. 3A and 3B, the recess 21 and the projection 22 have circular cross-sectional shapes. The bottom of the recess 21 has two stepped portions that are arranged downwardly. More specifically, if the recess 21 is defined as a large diameter recess 21, a circular intermediate diameter recess 29 is defined at the center of the bottom of the large diameter recess 21 and a circular small diameter recess 30 is defined at the center of the bottom of the intermediate diameter recess 29. A connection cylinder 32 having a circular cross-sectional shape projects downward from the center of the projection 22 of the cartridge accommodation casing 12. The connection cylinder 32 extends through the intermediate diameter recess 29 and is inserted partially into the small diameter recess 30. The seal valve chamber 34 is thus defined by the bottom of the connection cylinder 32 and the bottom and the circumferential surface of the small diameter recess 30. An annular seal ring 28 is fitted in the space defined by the projection 22, the connection cylinder 32, and the bottom and the circumferential surface of the intermediate diameter recess 29. The seal ring 28 seals the seal valve chamber 34 from the large diameter recess 21 and the exterior of the body 20.

Figure 3C:
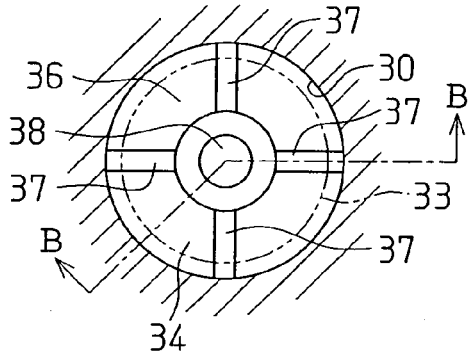
FIG. 3C is a plan view showing a seal valve chamber of FIG. 3B.
Figure 4A:
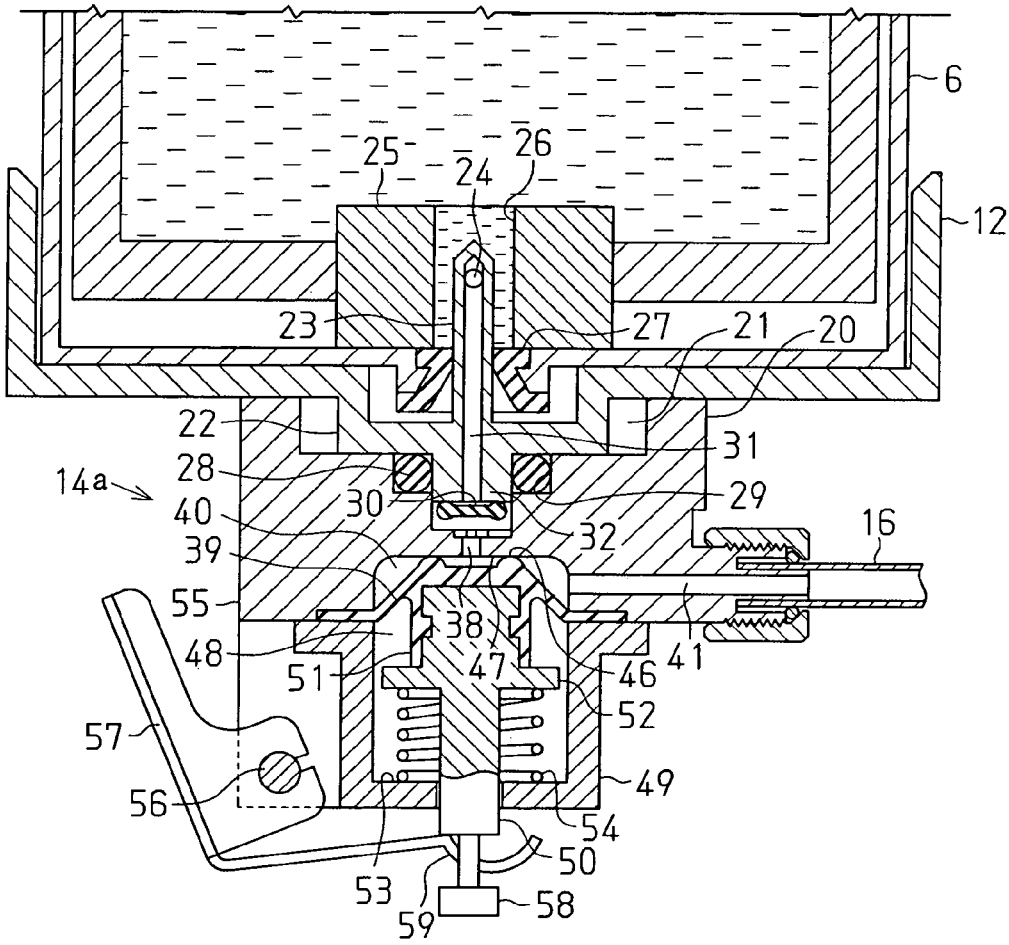
FIG. 4A is a cross-sectional view showing the control valve and the seal valve of FIG. 3A in closed states.
Figure 4B:
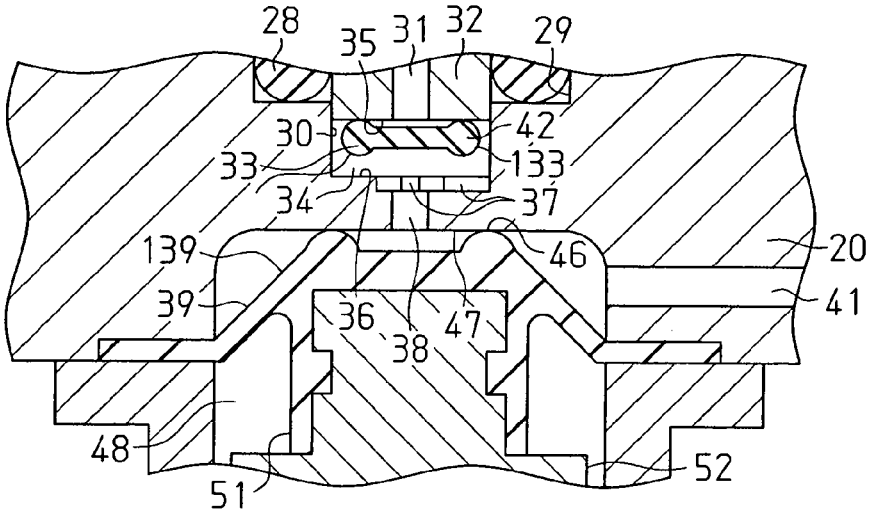
FIG. 4B is an enlarged view showing a portion of FIG. 4A.

A flat surface 35 is formed at a lower end of the connection cylinder 32. The ink outlet line 31 of the ink supply needle 23 includes the interior of the connection cylinder 32. The outlet port 31*a* of the ink outlet line 31 has an opening defined at the center of the flat surface 35 of the connection cylinder 32. A seal valve body 33 is allowed to contact the flat surface 35. The bottom of the seal valve chamber 34, which is opposed to the flat surface 35, functions as a passage defining surface 36 for allowing an ink flow to the first and second recording heads 7, 8. As shown in FIGS. 4A and 4B, when the seal valve body 33 contacts the flat surface 35, the outlet port 31*a* of the ink outlet line 31 is blocked. Referring to FIGS. 3B and 3C, a cross-shaped communication groove 37 is defined in the passage defining surface 36. When the seal valve body 33 is held in contact with the passage defining surface 36, a thick portion 42 of the seal valve body 33 encompasses a communication hole 38. In this state, the ink in the seal valve chamber 34 flows from outside of the thick portion 42 into the communication groove 37 and flows into the communication hole 38. The ink is thus supplied to the first and second recording heads 7, 8. In this manner, when the seal valve 133 is held in an open state, the communication groove 37 functions as a liquid flow allowing portion that allows the liquid flow from the seal valve chamber 34 to the control valve 139.

The communication hole 38 has an opening to the control valve chamber 40 and the control valve chamber 40 communicates with the ink supply tube 16 through the outlet hole 41. A passage including the seal valve chamber 34, the control valve chamber 40, the outlet hole 41, and the ink supply tube 16 functions as an ink supply line, or a liquid supply line, for connecting the ink outlet line 31 of the ink supply needle 23 to the first and second recording heads 7, 8.

Figure 3D:
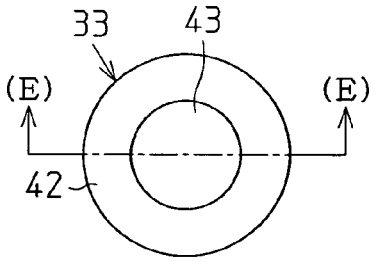
FIG. 3D is a plan view showing a seal valve body of FIG. 3B.

The seal valve body 33 is formed of light elastic material such as elastomer. As shown in FIGS. 3B, 3D, and 3E, the seal valve body 33 has a disk-like shape and includes a flat portion 43 and an annular thick portion 42 encompassing the flat portion 43. The thick portion 42 has a substantially circular cross-sectional shape. The diameter of the seal valve body 33 is smaller than the diameter of the circumferential surface of the circular seal valve chamber 34. This defines a clearance between the thick portion 42 and the circumferential surface of the seal valve chamber 34. The ink is allowed to flow through the clearance. The seal valve body 33 is received in the seal valve chamber 34 in an unrestricted state without being fixed to any part of the seal valve chamber 34. Referring to FIGS. 3B and 3E, the lower surface of the seal valve body 33 is shaped in such a manner that the flat portion 43 opposed to the communication hole 38 is located inward from the thick portion 42, which encompasses the flat portion 43. Therefore, the ink pressure applied from the communication hole 38 to the seal valve body 33 is reliably received by the lower surface of the seal valve body 33 in directions indicated by arrows 44 in FIG. 3E. This allows the seal valve body 33 to move with relatively quick response for contacting the flat surface 35 immediately.

The distance between the flat surface 35 and the opposing passage defining surface 36 is smaller than the diameter of the seal valve body 33. More specifically, the distance between the flat surface 35 and the opposing passage defining surface 36 is set to a rate of, preferably, 0.3 to 0.8, and, more preferably, to 0.4 to 0.6, with respect to the diameter of the seal valve body 33. This prevents the seal valve body 33 from reversing in the seal valve chamber 34, thus ensuring highly reliable valve operation. Further, the traveling distance of the seal valve body 33 from the passage defining surface 36 to the flat surface 35 becomes relatively small. That is, when the ink pressure is applied from the communication hole 38 to the seal valve body 33, the seal valve body 33 blocks the ink outlet line 31 with improved response and in a relatively short time. Also, the seal valve 133 is located at a position maximally close to the control valve 139, thus shortening the communication hole 38 that connects the seal valve chamber 34 to the control valve chamber 40. This arrangement makes it easy for the seal valve body 33 to sense change of the ink pressure when the control valve 139 is being closed. The seal valve body 33 thus operates with quick response. Therefore, the seal valve 133 closes before the control valve 139 closes.

A control valve body 39 is formed of elastic material such as elastomer, like the seal valve body 33. The control valve body 39 is formed like a diaphragm having an attachment cylinder 51. An annular raised portion 46 projects from a middle portion of the diaphragm. The raised portion 46 contacts a seat surface 47 corresponding to the ceiling of the control valve chamber 40 for closing the communication hole 38, or, in other words, shuttering the ink supply line of the inkjet recording apparatus.

A cupped casing 49 having a circular cross-sectional shape is joined with the lower surface of the body 20. The body 20 and the casing 49 define the control valve chamber 40 for receiving the control valve body 39. A flange is formed at the opening end of the casing 49 and, together with the lower surface of the body 20, clamps and supports a circumferential portion of the diaphragm of the control valve body 39. The circumferential portion of the diaphragm functions also as a seal for preventing the ink from leaking from the control valve chamber 40. The inner surfaces of the casing 49 and the diaphragm of the control valve body 39 define an operation chamber 48 for operating the control valve 139. A transmission shaft 50 is accommodated in the operation chamber 48. The transmission shaft 50 extends vertically with the attachment cylinder 51 of the control valve body 39 secured to the upper end of the transmission shaft 50. A flange 52 projects from an intermediate portion of the transmission shaft 50. A compression coil spring 54 is arranged between the flange 52 and a bottom surface 53 of the casing 49. The compression coil spring 54 functions as an urging member for urging the control valve body 39 upwardly, or, in a closing direction of the control valve 139.

A projection piece 55 is attached to the lower end of the body 20. A pivotal shaft 56 is pivotally supported by the projection piece 55. The operational lever 57 having a bent shape is secured to the pivotal shaft 56 in such a manner as to pivot integrally with the pivotal shaft 56. The transmission shaft 50 extends downward with a lower end 58 of the transmission shaft 50 projecting to the exterior of the operation chamber 48. An engagement portion 59 is formed at a distal end of the operational lever 57 and engaged with the lower end 58 of the transmission shaft 50.

The operational lever 57 pivots between a control valve open position shown in FIG. 3A and a control valve closed position shown in FIGS. 4A and 4B. When held at the control valve open position, the control valve body 39 opens the communication hole 38. When held at the control valve closed position, the control valve body 39 closes the communication hole 38. The transmission shaft 50 and the operational lever 57 form a valve opening, operation mechanism for forcibly opening the control valve 139.

The operational lever 57 is connected to a valve opening actuator 111. The valve opening actuator 111 is driven under instructions of a controller 110, which serves as a computer device that controls the recording apparatus as a whole. The controller 110 also controls a capping actuator 112 that actuates the capping device 62. Further, the controller 110 controls a vacuum pump 113 that applies negative pressure to the first and second recording heads 7, 8 for cleaning.

The valve opening actuator 111 applies urging force to the operational lever 57 for forcibly opening the control valve 139. More specifically, as shown in FIG. 3A, the valve opening actuator 111 operates to urge the operational lever 57 against the urging force of the compression coil spring 54 in such a manner as to pivot the operational lever 57 clockwise. In this state, the transmission shaft 50 moves downward and thus opens the control valve 139. In contrast, referring to FIG. 4A, if the valve opening actuator 111 is operated to pivot the operational lever 57 counterclockwise or simply stopped, the transmission shaft 50 is moved upward by the urging force of the compression coil spring 54. The control valve body 39 thus contacts the seat surface 47 and thus closes the control valve 139.

The operation of the first embodiment will hereafter be explained.

In the state of FIG. 3A, the controller 110 operates the valve opening actuator 111 for pivoting the operational lever 57 clockwise, thus moving the transmission shaft 50 downward. The control valve 139 is thus opened against the urging force of the compression coil spring 54. If the controller 110 activates the pressurization pump 13 in this state, the ink in the ink cartridge 6 flows from the inlet port 24 of the ink supply needle 23 into the ink outlet line 31. The ink then flows into the ink supply line including the seal valve chamber 34, the communication groove 37, the communication hole 38, the control valve chamber 40, the outlet hole 41, and the ink supply tube 16. The ink is thus supplied to the first and second recording head 7, 8 and ejected from the first and second recording heads 7, 8 as ink droplets.

When cleaning the first and second recording heads 7, 8, the controller 110 stops the pressurization pump 13 and activates the capping actuator 112, thus causing the capping device 62 to seal the first and second recording heads 7, 8. The controller 110 then actuates the vacuum pump 113 and thus applies negative pressure to the first and second recording heads 7, 8, which is required for cleaning operation. As shown in FIG. 4A, when the operational lever 57 is pivoted counterclockwise, the urging force of the compression coil spring 54 moves the control valve body 39 upward. The raised portion 46 of the control valve body 39 thus contacts the seat surface 47 and blocks the communication hole 38. In other words, the ink supply line is shuttered. When the control valve 139 is closed, the ink supply to the first and second recording heads 7, 8 is stopped. Therefore, by actuating the vacuum pump 113 in this state continuously for a predetermined time, the negative pressure acting between the control valve 139 and the first and second recording heads 7, 8 reaches a predetermined level sufficient for the cleaning operation. At this stage, the controller 110 actuates the valve opening actuator 111 for pivoting the operational lever 57 clockwise against the urging force of the compression coil spring 54. This opens the control valve 139, as shown in FIG. 3A, causing the ink in the ink cartridge 6 to rapidly flow into small passages that are defined in the first and second recording heads 7, 8. In this manner, the cleaning operation is carried out effectively.

The operation of the first embodiment in a transitional state between an open state and a closed state of the control valve 139 will hereafter be explained. As shown in FIG. 4A, when the operational lever 57 is pivoted counterclockwise, the control valve body 39 is moved upward, or in the closing direction of the control valve 139, by the urging force of the compression coil spring 54. The control valve body 39 thus presses the ink in the communication hole 38 upward. The ink, in turn, presses the seal valve body 33 upward, thus placing the seal valve body 33 in contact with the flat surface 35 for sealing the outlet port 31*a* of the ink supply needle 23. In other words, the ink pressure applied from the control valve body 39 to the ink outlet line 31 of the ink supply needle 23 causes the seal valve body 33 to seal the ink outlet line 31 of the ink supply needle 23.

When held in contact with the seat surface 47, the raised portion 46 of the control valve body 39 is squeezed and elastically deformed, extending in lateral directions. This reduces the space in the control valve chamber 40 that communicates with the communication hole 38 and is closed by the annular raised portion 46. The pressure of the ink that flows through the communication hole 38 and presses the seal valve body 33 upward is thus further increased.

Since the ink pressure pressing the seal valve body 33 upward is maintained in the seal valve chamber 34 and the communication hole 38 as long as the control valve 139 blocks the communication hole 38, the seal valve 133 is held in the closed state, which is brought about in the above-described manner. However, when the valve opening actuator 111 is actuated and the control valve 139 is opened against the urging force of the compression coil spring 54, the ink in the seal valve chamber 34 escapes to the control valve chamber 40 through the communication hole 38. This causes the seal valve body 33 to fall on the passage defining surface 36, thus opening the ink outlet line 31 of the ink supply needle 23. That is, the seal valve 133 becomes open immediately after the control valve 139 becomes open. The ink supply from the ink cartridge 6 to the first and second recording heads 7, 8 is thus resumed quickly.

For replacing the ink cartridge 6 by an unused product or an ink cartridge of a different color, such replacement is first commanded by the user to the controller 110. The controller 110 thus stops the pressurization pump 13 and operates to pivot the operational lever 57 counterclockwise, as shown in FIG. 4A, closing the control valve 139. In the transitional state from the open state to the closed state of the control valve 139, the seal valve 133 is closed in correspondence with closing of the control valve body 39, as in the case of the cleaning operation. That is, the seal valve body 33 is held in contact with the flat surface 35. In this state, the ink cartridge 6 is separated from the ink supply needle 23. At this stage, since the seal valve body 33 blocks the outlet port 31*a* of the ink supply needle 23, the ink in the ink outlet line 31 of the ink supply needle 23 does not leak from the inlet port 24 that is exposed to the exterior.

Figure 3F:
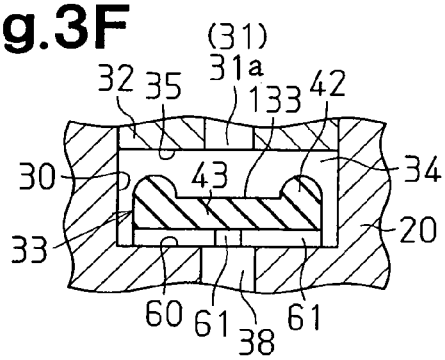
FIG. 3F is a cross-sectional view showing a modification of the seal valve of FIG. 3B.
Figure 3E:
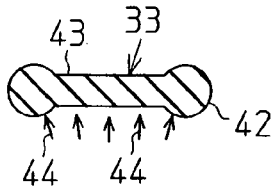
FIG. 3E is a cross-sectional view taken along line E-E of FIG. 3D.

Further, as shown in FIG. 3F, the communication groove 37 having ink flow allowing function may be defined in the seal valve body 33 instead of the passage defining surface 36 of the seal valve chamber 34. More specifically, a communication groove 61 serving as a liquid flow allowing portion is defined in a crossed shape in the lower surface of the seal valve body 33. The bottom of the seal valve chamber 34 forms a flat surface 60. The remaining structure is identical to that of FIG. 3B and same or like reference numerals are given to parts in FIG. 3F that are the same as or like corresponding parts in FIG. 3B. The structure of FIG. 3F has the same advantages as those of FIG. 3B.

The first embodiment has the following advantages.

The control valve 139 is provided in the ink supply line for closing the ink supply line when negative pressure is applied to the first and second recording heads 7, 8. The seal valve 133 is arranged between the control valve 139 and the ink supply needle 23 for sealing the ink supply line using the ink pressure applied from the control valve 139 to the ink outlet line 31. Thus, when the control valve body 39 is moved for closing the control valve 139 in the transitional state from the open state to the closed state of the control valve 139, the ink pressure applied from the control valve body 39 to the ink outlet line 31 of the ink supply needle 23 urges the seal valve body 33 in such a manner as to close the seal valve 133, thus blocking the ink supply line. This stops the ink flow from the control valve chamber 40 to the ink outlet line 31 of the ink supply needle 23. Accordingly, the ink is prevented from leaking from the ink supply needle 23 when the ink cartridge 6 is separated from the ink supply needle 23.

The negative pressure is applied to the first and second recording heads 7, 8 with the control valve 139 held in the closed state. The control valve 139 is then opened when the negative pressure reaches the predetermined level. In this manner, the ink in the ink cartridge 6 rapidly flows into the small passages defined in the first and second recording heads 7, 8. The cleaning operation is thus performed effectively.

The seal valve 133 is provided between the control valve 139 and the ink supply needle 23. Therefore, when the outlet port 31*a* is sealed by the seal valve 133 in the closed state of the control valve 139, the amount of ink the pressure of which is equal to the ink pressure at the inlet port 24 of the ink supply needle 23 is as small as the amount of the ink in the ink supply needle 23. This makes it easy to prevent the ink from leaking from the ink supply needle 23 when the ink cartridge 6 is separated from the ink supply needle 23.

The seal valve body 33 is arranged in the immediate vicinity of the ink outlet line 31 of the ink supply needle 23. This minimizes the volume of the ink retained in the portion from the position at which the ink outlet line 31 is sealed by the seal valve body 33 to the inlet port 24, or the distal end, of the ink outlet line 31. The ink is thus further easily prevented from leaking from the ink supply needle 23.

The seal valve body 33 is accommodated in the seal valve chamber 34, which is defined in the ink supply line, in the unrestricted state. Therefore, even if the ink flow caused by movement of the control valve body 39 is extremely small, the seal valve body 33 moves to the position for sealing the ink outlet line 31 with quick response, thus reliably sealing the ink outlet line 31. Further, as has been described, the seal valve body 33 is arranged in the seal valve chamber 34 without being fixed to any part of the seal valve chamber 34, with a predetermined clearance defined between the seal valve body 33 and the circumferential wall of the seal valve chamber 34. The seal valve 133 is thus easily assembled in a relatively small space. This is advantageous in designing of the seal valve 133, particularly, components in the vicinity of the seal valve body 33.

The wall surfaces of the seal valve chamber 34 include the flat surface 35 and the passage defining surface 36 opposed to the flat surface 35. The seal valve body 33 contacts the flat surface 35 and thus seals the ink outlet line 31 of the ink supply needle 23. The passage defining surface 36 allows the ink flow from the control valve chamber 40 to the first and second recording heads 7, 8. Since the flat surface 35 and the passage defining surface 36 are opposed to each other, the seal valve body 33 is allowed to switch between the seal function and the ink flow allowing function simply by reciprocating in the seal valve chamber 34. That is, the seal valve 133 reliably functions as a check valve through simple operation.

The compression coil spring 54 urges the control valve body 39 in such a manner as to close the control valve 139. Closing of the control valve 139 is thus promoted by the compression coil spring 54, and the control valve 139 is reliably closed in a relatively short time.

The operational lever 57 is operated for switching the control valve 139 from the closed state to the open state. When the ink cartridge 6 is separated from the ink supply needle 23 for replacement, the control valve 139, or the seal valve 133, is held in the closed state. After the replacement is completed, the operational lever 57 is pivoted for opening the control valve 139, thus opening the seal valve 133. This allows the ink to be supplied from the ink cartridge 6 immediately after the replacement.

The ink in the ink cartridge 6 is pressurized by the pressurization pump 13. Since the ink pressure in the control valve chamber 40 acts against the urging force of the compression coil spring 54, the control valve 139 closes at a correspondingly low speed. However, as has been described, the seal valve body 33 is arranged in the seal valve chamber 34 in an unrestricted state. Thus, even if the ink pressure applied by the control valve 139 is increased only by a small amount, the seal valve body 33 moves with quick response and contacts the flat surface 35. That is, the seal valve 133 functions with improved response.

A second embodiment of the present invention will now be described with reference to FIG. 5, focusing on the structure of the seal valve chamber 34, which is different from that of the first embodiment.

Figure 5:
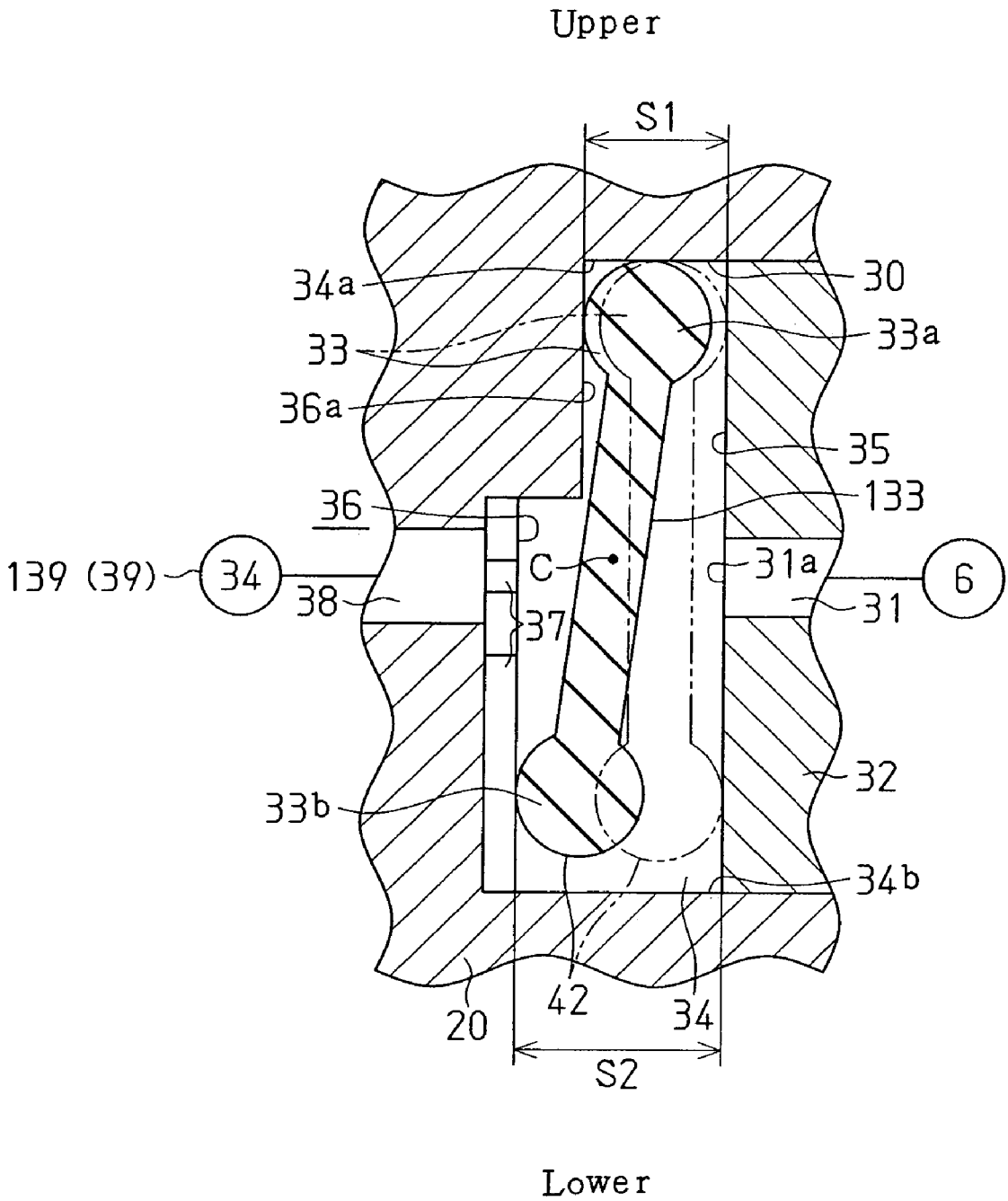
FIG. 5 is a cross-sectional view showing a seal valve according to a second embodiment of the present invention.

FIG. 5 is a partial cross-sectional view showing the seal valve chamber 34 and the seal valve 133. In the second embodiment, the seal valve chamber 34 is configured in such a manner that the ink pressure (the liquid pressure) is applied horizontally from the control valve 139 to the ink outlet line 31. A ceiling surface 34*a* of the seal valve chamber 34 is smaller that a bottom surface 34*b* of the seal valve chamber 34. More specifically, in the seal valve chamber 34, a step 36*a* is formed in a portion of the passage defining surface 36 closer to the ceiling surface 34*a*, in such a manner as to reduce the distance between this portion and the flat surface 35, as compared to a portion of the passage defining surface 36 closer to the bottom surface 34*b*.

The seal valve body 33 is received in the seal valve chamber 34 with a longitudinal direction of the seal valve body 33 coinciding with a vertical direction. In the second embodiment, the specific gravity of the seal valve body 33 is smaller than that of the ink. That is, the seal valve body 33 is formed of a material that floats in the seal valve chamber 34. Therefore, an upper end 33*a* of the seal valve body 33, or one end of the seal valve body 33, is constantly held in contact with the ceiling surface 34*a* of the seal valve chamber 34. Contrastingly, a lower end 33*b* of the seal valve body 33, or the opposing end of the seal valve body 33, floats in the seal valve chamber 34 as slightly separated from the bottom surface 34*b*.

As has been explained for the first embodiment, the seal valve body 33 moves in a direction in which the ink pressure acts, or, in the second embodiment, in a horizontal direction. The seal valve body 33 thus selectively opens and closes the ink outlet line 31. In the second embodiment, the size of the bottom surface 34*b* of the seal valve chamber 34 is sufficiently larger than that of the thick portion 42 of the seal valve body 33. Thus, the lower end 33*b* of the seal valve body 33 is allowed to move in a relatively wide range. In contrast, the size of the ceiling surface 34*a* of the seal valve chamber 34 is reduced by the step 36*a* to the size substantially equal to that of the thick portion 42 of the seal valve body 33. Therefore, compared to the lower end 33*b*, movement of the upper end 33*a* of the seal valve body 33 is restricted. In other words, a movement range S1 of the upper end 33*a* of the seal valve body 33 (=the size of the ceiling surface 34*a*) is smaller than a movement range S2 of the lower end 33*b* (=the size of the bottom surface 34*b*).

The remaining structure of the seal valve chamber 34 is identical to that of the structure of FIG. 3B and same or like reference numerals are given to parts in FIG. 5 that are the same as or like corresponding parts in FIG. 3B.

The operation of the second embodiment will hereafter be explained.

In the state indicated by the solid lines in FIG. 5, the seal valve body 33 opens the ink outlet line 31 of the ink supply needle 23. In contrast, in the state indicated by the broken lines in the drawing, the seal valve body 33 closes the ink outlet line 31. Like the first embodiment, when the control valve body 39 is moved for closing the control valve 139 in the transitional state from the open state to the closed state of the control valve 139, the ink pressure is applied from the control valve body 39 to the ink outlet line 31 of the ink supply needle 23. In the second embodiment, the ink pressure is applied by the control valve 139 in a horizontal direction, or, more particularly, from the left to the right as viewed in FIG. 5.

In this state, the ink pressure urges the seal valve body 33 toward the ink outlet line 31, or, more particularly, rightward as viewed in FIG. 5. Since the movement range S1 of the upper end 33*a* of the seal valve body 33 is substantially equivalent to the size of the thick portion 42 of the seal valve body 33, the upper end 33*a* is substantially prohibited from moving. Therefore, when receiving the ink pressure acting in the horizontal direction, the seal valve body 33 pivots counterclockwise about the upper end 33*a* as fulcrum, as viewed in FIG. 5, until the lower end 33*b* contacts the flat surface 35. In this manner, the seal valve body 33 seals the outlet port 31*a* of the ink supply needle 23.

Contrastingly, when the control valve 139 becomes open, the pressure in the control valve chamber 40 becomes negative and the seal valve body 33 moves away from the ink outlet line 31, or, more particularly, leftward as viewed in FIG. 5. In this state, the upper end 33*a* is substantially prohibited from moving, as in the case of closing of the control valve 139. The seal valve body 33 thus pivots clockwise as viewed in the drawing about the upper end 33*a* serving as the fulcrum, until the lower end 33*b* of the seal valve body 33 contacts the passage defining surface 36. This opens the outlet port 31*a* of the ink supply needle 23, causing the ink to flow from the ink cartridge 6 to the first and second recording heads 7, 8.

The remainder of the operation of the second embodiment is the same as that of the first embodiment and will be omitted from the explanation.

The second embodiment has the following advantages in addition to those of the first embodiment.

The seal valve body 33 is received in the seal valve chamber 34 in such a manner that the movement range S1 of the upper end 33*a* becomes smaller than the movement range S2 of the lower end 33*b*, or the following inequality is satisfied: S1<S2. That is, the lower end 33*b* of the seal valve body 33 is allowed to move in a relatively wide range. In contrast, movement of the upper end 33*a* is restricted compared to that of the lower end 33*b*, or the upper end 33*a* is allowed to move only in a relatively small range.

The outlet port 31*a* of the ink supply needle 23 is sealed by a portion of the seal valve body 33 in the vicinity of the center C of the seal valve body 33. As indicated by the solid lines in FIG. 5, when the seal valve body 33 maintains the ink outlet line 31 in an open state, the center C of the seal valve body 33 is spaced from the outlet port 31*a* of the ink outlet line 31 by a half of S2 (=S2/2). However, if, for example, the step 36*a* is not provided, or the following equation is satisfied: S1=S2, the center C of the seal valve body 33 is spaced from the outlet port 31*a* of the ink outlet line 31 by S2 and contacts the passage defining surface 36. In other words, in the seal valve 133 of FIG. 5, the step 36*a* restricts movement of the seal valve body 33 and reduces the stroke of reciprocation of the seal valve body 33.

If the step 36*a* is not provided, the lateral movement distance of the center C of the seal valve body 33 decreases to a half of the corresponding dimension of the first embodiment of FIGS. 3A and 3B. This allows the seal valve body 33 to quickly seal the ink outlet line 31 when receiving the ink pressure applied horizontally from the control valve 139 to the ink outlet line 31. That is, the seal valve 133 functions with improved response.

In the second embodiment, the specific gravity of the seal valve body 33 is smaller than that of the ink. The seal valve body 33 thus floats in the seal valve chamber 34. The upper end 33*a* of the seal valve body 33, or the one end of the seal valve body 33, is constantly held in contact with the ceiling surface 34*a* of the seal valve chamber 34. When receiving the ink pressure applied horizontally to the ink outlet line 31 in this state, the seal valve body 33 pivots with the upper end 33*a*, which is allowed to move only in the relatively small movement range S1, serving as the fulcrum. In other words, sealing of the outlet port 31*a* of the ink outlet line 31 is smoothly achieved by setting the movement ranges S1, S2 in correspondence with the specific gravity of the seal valve body 33 relative to that of the ink. This further improves response of the seal valve 133. Further, if the inkjet recording apparatus is placed on a slanted or uneven surface, instead of a horizontal surface, the seal valve body 33 is maintained in a floating state. The upper end 33*a* of the seal valve body 33 is thus constantly held in contact with the ceiling surface 34*a* of the seal valve chamber 34 in a movement restricted manner. Accordingly, the position and the movement distance of the seal valve body 33 are maintained constant, and the function of the seal valve 133 becomes reliable and stable.

It should be apparent to those skilled in the art that the present invention may be embodied in many other specific forms without departing from the sprit or scope of the invention. Particularly, it should be understood that the invention may be embodied in the following forms.

In each of the illustrated embodiment, the ink cartridges 6 are arranged in groups at the opposing ends of the inkjet recording apparatus. However, the present invention may be allied to a type in which the ink cartridges 6 are provided at one of the ends without changing the operation of the apparatus.

In each of the illustrated embodiments, the present invention is applied to the inkjet recording apparatus. However, the present invention may be applied to an ejection apparatus ejecting, for example, glue, manicure, or conductive liquid (such as liquid metal). Further, instead of the inkjet recording apparatus ejecting ink, a type of liquid, the present invention may be applied generally to liquid ejection apparatuses including recording apparatuses used in image recording apparatuses such as printers, color material ejection apparatuses used in fabrication of color filters of liquid crystal displays, electrode material ejection apparatuses used in fabrication of electrodes of organic EL displays or field emission displays (FEDs), and bioorganic matter ejection apparatuses used in fabrication of biochips.

In the second embodiment, the seal valve body 33 may be formed of material having a specific gravity greater than that of the ink. In this case, the step 36*a* is formed in such a manner that the movement range S2 of the lower end 33*b* becomes smaller than the movement range S1 of the upper end 33*a*. Since the specific gravity of the seal valve body 33 is greater than that of the ink, the seal valve body 33 is constantly maintained in a state sitting in the seal valve chamber 34 with the lower end 33*b* held in contact with the bottom surface 34*b*. Thus, when receiving the ink pressure acting in a horizontal direction, the seal valve body 33 moves, or pivots, with the lower end 33*b* serving as fulcrum. Accordingly, this structure has the same advantages as the structure in which the specific gravity of the seal valve body 33 is smaller than that of the ink.

In the second embodiment, the seal valve chamber 34 having the step 36*a* may be configured in such a manner that the ink pressure (the liquid pressure) is applied vertically from the control valve 139 to the ink outlet line 31. In other words, although the seal valve body 33 of the second embodiment is configured in accordance with "tower-like arrangement", the seal valve body 33 may be configured in accordance with "transverse arrangement". Also in this case, the step 36*a* is formed in the seal valve chamber 34 in such a manner that the movement range S1 of an end 33*a* of the seal valve body 33 in a direction crossing the acting direction of the ink pressure applied from the control valve 139 to the ink outlet line 31 becomes relatively small. This shortens the movement distance of the center C of the seal valve body 33 from the position at which the seal valve body 33 opens the ink outlet line 31 to the position at which the seal valve body 33 contacts the flat surface 35, thus improving the response of the seal valve 133.

In the second embodiment, the step 36*a* of the seal valve chamber 34 is formed integrally with the body 20 of the valve device 14*a*. However, the step 36*a* may be formed in the seal valve chamber 34 independently from the body 20 of the valve device 14*a*, in such a manner as to reduce the movement range S1 of the upper end 33*a* or the movement range S2 of the lower end 33*b*. Alternatively, as long as the movement range S1 or the movement range S2 is reduced, different structures may be selected instead of the step 36*a*, such as a pin projecting from the wall of the control valve chamber 40.

In the second embodiment, the upper end 33*a* of the seal valve body 33 may be pivotally supported by the wall of the control valve chamber 40 by means of a shaft or a bearing surface. This arrangement may be employed also in a structure in which the movement range S2 of the lower end 33*b* of the seal valve body 33 is smaller than the movement range S1 of the upper end 33*a*.

The present examples and embodiments are to be considered as illustrative and not restrictive and the invention is not to be limited to the details given herein, but may be modified within the scope and equivalence of the appended claims.

What is claimed is:

1. A liquid ejection apparatus ejecting a liquid retained in a liquid container from a liquid ejection head, the apparatus comprising:

a liquid supply needle having an outlet line that can be connected to the interior of the liquid container;

a liquid supply line connecting the outlet line of the liquid supply needle to the liquid ejection head;

a control valve provided in the liquid supply line, wherein the control valve closes the liquid supply line when negative pressure is applied to the liquid ejection head; and a seal valve arranged between the control valve and the liquid supply needle in the liquid supply line, wherein the seal valve seals the liquid supply line using liquid pressure applied from the control valve to the outlet line.

2. The apparatus according to claim 1, wherein the seal valve is arranged in the immediate vicinity of the outlet line.

3. The apparatus according to claim 1, wherein the seal valve includes a seal valve chamber defined in the liquid supply line and a seal valve body received in the seal valve chamber in an unrestricted state.

4. The apparatus according to claim 3, wherein the seal valve chamber includes a flat surface and a passage defining surface opposed to the flat surface, the flat surface cooperating with the seal valve body for sealing the liquid supply line when the seal valve body contacts the flat surface, and wherein the liquid supply line from the control valve has an opening defined in the passage defining surface.

5. The apparatus according to claim 4, wherein at least one of the passage defining surface and the seal valve body includes a liquid flow allowing portion that allows a flow of the liquid from the seal valve chamber to the control valve when the seal valve is open.

6. The apparatus according to claim 1, wherein the seal valve includes a seal valve chamber defined in the liquid supply line and a seal valve body received in the seal valve chamber, wherein the seal valve body has a first end and a second end located in a direction crossing an acting direction of the liquid pressure applied from the control valve to the outlet line, and wherein a movement range of the first end in the acting direction of the liquid pressure is smaller than that of the second end.

7. The apparatus according to claim 6, wherein the size of the seal valve chamber in the acting direction of the liquid pressure is set in such a manner that a dimension corresponding to the first end of the seal valve body is smaller than a dimension corresponding to the second end of the seal valve body.

8. The apparatus according to claim 6, wherein the seal valve chamber is configured in such a manner that the acting direction of the liquid pressure applied from the control valve chamber to the outlet line corresponds to a horizontal direction, and wherein the seal valve body extends vertically in the seal valve chamber in such a manner that the movement range of an upper end of the seal valve body becomes smaller than that of a lower end of the seal valve body if the specific gravity of the seal valve body is smaller than that of the liquid, and that the movement range of the lower end of the seal valve body becomes smaller than that of the upper end if the specific gravity of the seal valve body is greater than that of the liquid.

9. The apparatus according to claim 1, wherein the control valve includes a control valve body and an urging member for urging the control valve body in a closing direction of the control valve.

10. The apparatus according to claim 1, further comprising an operation mechanism for switching the control valve from a closed state to an open state.

11. The apparatus according to claim 1, wherein the seal valve closes before the control valve closes.

12. A liquid ejection apparatus ejecting a liquid retained in a liquid container from a liquid ejection head, the apparatus comprising:

a liquid supply needle having an outlet line that can be connected to the interior of the liquid container;

a liquid supply line connecting the outlet line of the liquid supply needle to the liquid ejection head;

a control valve provided in the liquid supply line, wherein the control valve closes the liquid supply line when negative pressure is applied to the liquid ejection head; and a seal valve arranged between the control valve and the liquid supply needle in the liquid supply line, wherein the seal valve includes a seal valve chamber defined in the liquid supply line and a seal valve body received in the seal valve chamber in an unrestricted state, and wherein, in a transitional state from an open state to a closed state of the control valve, the seal valve body seals the outlet line in response to change of the liquid pressure applied from the control valve.

* * * * *